US010786087B2

(12) United States Patent
Huang

(10) Patent No.: US 10,786,087 B2
(45) Date of Patent: Sep. 29, 2020

(54) ELECTRIC BED WITH INDEPENDENT ADJUSTING DEVICE FOR WAIST REST

(71) Applicant: APEX HEALTH CARE MFG. INC., Minxiong Township, Chiayi County (TW)

(72) Inventor: Chi-Chung Huang, Minxiong Township (TW)

(73) Assignee: APEX HEALTH CARE MFG. INC., Minxiong Township (TW)

( * ) Notice: Subject to any disclaimer, the term of this patent is extended or adjusted under 35 U.S.C. 154(b) by 273 days.

(21) Appl. No.: 15/854,928

(22) Filed: Dec. 27, 2017

(65) Prior Publication Data

US 2019/0191890 A1 Jun. 27, 2019

(51) Int. Cl.

| | |
|---|---|
| ***A47C 20/10*** | (2006.01) |
| ***A47C 19/02*** | (2006.01) |
| ***A47C 20/04*** | (2006.01) |
| ***A47C 20/08*** | (2006.01) |
| ***A61G 7/015*** | (2006.01) |

(52) U.S. Cl.

CPC ..... *A47C 20/10* (2013.01); *A47C 19/025* (2013.01); *A47C 20/041* (2013.01); *A47C 20/08* (2013.01); *A61G 7/015* (2013.01)

(58) Field of Classification Search

CPC ..... A47C 20/10; A47C 20/041; A47C 20/08; A47C 19/025; A61G 7/015

USPC ..... 5/616

See application file for complete search history.

(56) References Cited

U.S. PATENT DOCUMENTS

| | | | | | |
|---|---|---|---|---|---|
| 238,799 | A * | 3/1881 | Morgan | A61G 7/015 | 5/619 |
| 912,588 | A * | 2/1909 | Marseilles | A61H 1/0222 | 606/242 |
| 1,199,002 | A * | 9/1916 | Freise | A47C 9/06 | 297/14 |
| 1,201,017 | A * | 10/1916 | Brand | A61G 7/015 | 5/618 |
| 1,459,953 | A * | 6/1923 | Freise | A61G 13/009 | 606/245 |
| 1,761,673 | A * | 6/1930 | Lauris | A47C 9/06 | 297/14 |
| 1,775,547 | A * | 9/1930 | Bayer | A61G 7/015 | 5/618 |

(Continued)

FOREIGN PATENT DOCUMENTS

JP 2013236647 A * 11/2013 ..... A47C 20/10

OTHER PUBLICATIONS

Nakano Yuji, "Machine Translation—JP2013236647A", Nov. 28, 2013, pp. 9, 13 (Year: 2013).*

*Primary Examiner* — Nicholas F Polito
*Assistant Examiner* — Luke Hall
(74) *Attorney, Agent, or Firm* — Alan D. Kamrath; Mayer & Williams PC

(57) ABSTRACT

An electric bed includes a bed board unit, and an adjusting device mounted on a bottom of the bed board unit. The bed board unit includes a head board, a back board, a waist board, a hip board, a leg board and a foot board. The adjusting device includes a driving unit, a support unit, at least one track unit and at least one hinge unit. Thus, the waist board is pushed by the electric cylinder when the back board lies or is lifted, so that the waist board is operated independently and is lifted or lowered freely.

11 Claims, 14 Drawing Sheets

(56) References Cited

U.S. PATENT DOCUMENTS 2,042,399 A * 5/1936 Holme ..... A61G 13/08 297/70
2,193,882 A * 3/1940 Petersen ..... A61H 15/0078 606/239
2,579,783 A * 12/1951 Branto ..... A61G 13/105 5/617
2,605,151 A * 7/1952 Robert ..... A61G 13/0009 5/602
2,651,785 A * 9/1953 Berner ..... A61G 7/012 5/611
2,658,211 A * 11/1953 Sadie ..... A61G 7/075 5/646
2,794,694 A * 6/1957 Fullwood ..... A61G 13/02 5/614
2,851,320 A * 9/1958 Lorang ..... A61G 13/009 5/614
2,904,039 A * 9/1959 Weissenberg ..... A61G 7/07 606/237
2,996,732 A * 8/1961 Draper ..... A47C 20/08 5/616
3,041,121 A * 6/1962 Comper ..... A61G 13/00 5/618
3,051,965 A * 9/1962 Szemplak ..... A47C 20/042 5/616
3,206,188 A * 9/1965 Douglass, Jr. ..... A61G 13/02 5/614
3,281,141 A * 10/1966 Smiley ..... A61G 13/00 5/614
3,334,951 A * 8/1967 Douglass, Jr. ..... A61G 13/0018 312/209
3,478,372 A * 11/1969 Benoit ..... A61G 7/005 5/607
3,593,350 A * 7/1971 Knight ..... A47C 20/041 5/616
3,635,461 A * 1/1972 Bellucci ..... A61G 13/02 5/616
3,644,945 A * 2/1972 Goodman ..... A61G 7/018 5/616
3,754,749 A * 8/1973 Lyon ..... A61G 13/009 5/618
3,840,911 A * 10/1974 Benoit ..... A61G 7/015 5/618
3,868,103 A * 2/1975 Pageot ..... A61G 13/02 5/614
3,898,702 A * 8/1975 Goodman ..... A61G 7/015 5/618
3,972,081 A * 8/1976 Stern ..... A61G 7/002 5/618
3,977,664 A * 8/1976 Mitchell ..... A61G 13/02 5/614
4,120,057 A * 10/1978 Neumann ..... A47C 20/041 5/616
4,168,099 A * 9/1979 Jacobs ..... A61G 15/005 297/325
4,195,829 A * 4/1980 Reser ..... A61G 13/02 5/607
4,344,422 A * 8/1982 Immel ..... A61G 7/05 5/109
4,349,924 A * 9/1982 Zur ..... A47C 1/0242 5/615
4,395,786 A * 8/1983 Casey ..... A61G 7/015 5/616
4,516,805 A * 5/1985 Leeper ..... A47C 1/0244 297/188.07
4,535,492 A * 8/1985 Sebest ..... A61G 7/002 5/616
4,558,857 A * 12/1985 Heller ..... A61G 13/02 5/618
4,678,171 A * 7/1987 Sanders ..... A61G 13/12 5/618
4,742,586 A * 5/1988 Galumbeck ..... A47C 20/04 5/411
4,882,797 A * 11/1989 Failor ..... A61G 13/08 5/613
4,913,487 A * 4/1990 Breckel ..... A47C 13/00 297/14
4,956,592 A * 9/1990 Schulte ..... A61G 15/02 318/286
4,996,731 A * 3/1991 Kruyt ..... A47C 20/041 5/618
5,040,253 A * 8/1991 Cheng ..... A47C 17/16 5/616
5,044,359 A * 9/1991 Reinert ..... A61H 1/0292 601/23
5,063,623 A * 11/1991 Bathrick ..... A47C 20/041 5/616
5,072,463 A * 12/1991 Willis ..... A61G 7/005 5/616
5,109,558 A * 5/1992 Di Blasi ..... A61G 7/0573 5/236.1
5,133,741 A * 7/1992 Filho ..... A61H 1/008 5/613
5,136,742 A * 8/1992 Stebbins ..... A47C 19/045 5/610
5,269,031 A * 12/1993 Alexander ..... A47C 20/041 192/48.2
5,303,437 A * 4/1994 Hung ..... A61G 7/015 5/607
5,369,825 A * 12/1994 Reesby ..... A61G 13/0009 5/600
5,426,799 A * 6/1995 Ottiger ..... A47C 23/002 267/151
5,444,880 A * 8/1995 Weismiller ..... A61G 7/015 5/424
5,537,701 A * 7/1996 Elliott ..... A47C 19/005 5/616
5,544,375 A * 8/1996 Urness ..... A47C 20/041 5/611
5,568,661 A * 10/1996 Bathrick ..... A47C 20/041 5/285
5,628,078 A * 5/1997 Pennington ..... A61B 6/04 5/613
5,640,730 A * 6/1997 Godette ..... A47C 20/041 5/617
5,737,786 A * 4/1998 Yamamoto ..... A61G 7/0005 5/616
5,774,915 A * 7/1998 Scott ..... A61G 13/009 5/610
5,829,077 A * 11/1998 Neige ..... A47C 20/041 5/618
5,862,551 A * 1/1999 Oguma ..... A61G 7/015 403/231
5,865,457 A * 2/1999 Knabusch ..... A61G 5/006 280/304.1
5,926,002 A * 7/1999 Cavanaugh ..... A47C 31/008 297/284.3
6,006,379 A * 12/1999 Hensley ..... A47C 20/041 5/616
6,209,157 B1 * 4/2001 Hensley ..... A47C 20/041 5/613
6,216,295 B1 * 4/2001 Pearson ..... A47C 20/041 5/613
6,237,172 B1 * 5/2001 Morgan, Sr. ..... A61G 13/0018 5/600
6,276,011 B1 * 8/2001 Antinori ..... A47C 20/041 5/613
6,343,392 B1 * 2/2002 Becker ..... A47C 20/041 5/616
6,393,641 B1 * 5/2002 Hensley ..... A47C 20/041 5/613
6,615,429 B2 * 9/2003 Weil ..... A61B 6/0457 378/209
6,754,923 B2 * 6/2004 Borders ..... A61G 12/00 5/618
6,826,793 B2 * 12/2004 Tekulve ..... A47C 20/041 5/616
6,886,200 B2 * 5/2005 Blyshak ..... A61G 13/02 254/93 R

(56) References Cited

U.S. PATENT DOCUMENTS 6,986,180 B1 * 1/2006 Wilke ..... A47C 20/08 340/573.1
D604,422 S * 11/2009 Albrecht ..... D24/183
7,669,262 B2 * 3/2010 Skripps ..... A61G 13/04 5/621
7,849,539 B2 * 12/2010 Hornbach ..... A61G 7/018 5/610
7,913,336 B2 * 3/2011 Morin ..... A61G 7/015 5/613
7,979,932 B2 * 7/2011 Liang ..... A61G 13/08 5/612
8,397,323 B2 * 3/2013 Skripps ..... A61B 6/0421 5/601
8,495,774 B2 * 7/2013 Soltani ..... A61G 7/053 5/178
8,555,438 B2 * 10/2013 Turner ..... A61G 7/015 5/618
8,683,629 B2 * 4/2014 Clenet ..... A61G 7/015 5/613
8,955,178 B2 * 2/2015 Robertson ..... A47C 20/041 5/613
9,066,603 B2 * 6/2015 Mossbeck ..... A47C 20/041
9,119,753 B2 * 9/2015 Poulos ..... A61G 7/0514
9,301,897 B2 * 4/2016 Jackson ..... A61G 13/08
9,339,430 B2 * 5/2016 Jackson ..... A61G 13/0036
9,706,848 B2 * 7/2017 Shih ..... A61G 7/015
2002/0178502 A1 * 12/2002 Beasley ..... A61G 7/015 5/618
2004/0083549 A1 * 5/2004 L'Hegarat ..... A61G 13/08 5/621
2004/0194213 A1 * 10/2004 Weinman ..... A61G 7/015 5/618
2005/0120481 A1 * 6/2005 Farmont ..... A47C 20/041 5/618
2006/0026765 A1 * 2/2006 Hornbach ..... A61G 7/015 5/618
2007/0163045 A1 * 7/2007 Becker ..... A61G 7/012 5/616
2007/0214571 A1 * 9/2007 Piraino ..... A47C 7/462 5/616
2007/0216185 A1 * 9/2007 McMillen ..... B60N 2/856 296/64
2007/0220677 A1 * 9/2007 Dewert ..... A47C 20/041 5/618
2009/0094748 A1 * 4/2009 Long ..... A47C 20/08 5/613
2009/0178201 A1 * 7/2009 Lujan ..... A61G 7/015 5/618
2009/0195040 A1 * 8/2009 Birkbeck ..... A47C 1/03294 297/317
2010/0017964 A1 * 1/2010 Kruse ..... A61G 7/015 5/604
2010/0212087 A1 * 8/2010 Leib ..... G16H 40/20 5/81.1 R
2012/0138067 A1 * 6/2012 Rawls-Meehan .... A47C 20/041 128/845
2012/0159712 A1 * 6/2012 Lee ..... A61G 7/015 5/613
2012/0174316 A1 * 7/2012 Shih ..... A61G 7/015 5/600
2013/0025066 A1 * 1/2013 Shih ..... A47C 21/006 5/694
2013/0061398 A1 * 3/2013 Lim ..... A61G 7/0573 5/616
2013/0318717 A1 * 12/2013 Iheoma ..... A61G 13/08 5/600
2014/0000031 A1 * 1/2014 Westermann ..... A61G 7/012 5/611
2014/0009917 A1 * 1/2014 Westermann ..... A61G 7/0506 362/130
2014/0041121 A1 * 2/2014 Shan ..... A47C 20/041 5/618
2014/0123391 A1 * 5/2014 Shan ..... A61G 7/015 5/616
2014/0259409 A1 * 9/2014 Shih ..... A61G 7/015 5/600
2014/0304916 A1 * 10/2014 Guo ..... A61G 7/015 5/616
2014/0304917 A1 * 10/2014 Ruch ..... H02P 8/00 5/616
2014/0352068 A1 * 12/2014 Xu ..... A61G 7/015 5/616
2015/0007391 A1 * 1/2015 Xu ..... A61G 7/018 5/616
2015/0067965 A1 * 3/2015 Xu ..... A61G 7/018 5/616
2015/0121623 A1 * 5/2015 Huang ..... A61G 7/018 5/616
2015/0182397 A1 * 7/2015 Palashewski ..... A47C 27/14 5/616
2016/0193095 A1 * 7/2016 Roussy ..... A61G 7/0514 5/11
2016/0262549 A1 * 9/2016 Rawls-Meehan .... A47C 20/027
2017/0347806 A1 * 12/2017 Shih ..... A47C 20/041
2018/0103768 A1 * 4/2018 Nava ..... A47C 19/02
2018/0296412 A1 * 10/2018 Huang ..... A61G 7/018

* cited by examiner

ELECTRIC BED WITH INDEPENDENT ADJUSTING DEVICE FOR WAIST REST

BACKGROUND OF THE INVENTION

1. Field of the Invention

The present invention relates to a bed and, more particularly, to an electric bed.

2. Description of the Related Art

A conventional electric bed comprises a back board that is pivoted to change its inclined angle, so that the inclined angle of the back board can be adjusted according to a user's requirement to provide a comfortable sensation to the user when lying on the electric bed. However, when the user's back rests on the back board, the user's waist does not have any support, so that the user easily feels uncomfortable. Another conventional electric bed comprises a back board and a waist rest. When the back board is pushed and pivoted by an electric cylinder to change its inclined angle, the waist rest is also pushed and moved by the electric cylinder. Thus, when the electric bed is disposed at an inclined state, the user's waist is supported by the waist rest. However, when the electric bed is disposed at a horizontal state, the waist rest is also disposed at a horizontal state, so that the user's waist does not have any support when lying down.

BRIEF SUMMARY OF THE INVENTION

The primary objective of the present invention is to provide an electric bed with an independent adjusting device for waist rest and support.

In accordance with the present invention, there is provided an electric bed comprising a bed board unit, and an adjusting device mounted on a bottom of the bed board unit. The bed board unit includes a head board, a back board, a waist board, a hip board, a leg board and a foot board. The bed board unit further includes a bed frame located under the head board, the back board, the waist board, the hip board, the leg board and the foot board. The adjusting device includes a driving unit, a support unit, at least one track unit and at least one hinge unit. The driving unit includes an electric cylinder and a push rod. The electric cylinder is secured on a bottom of the hip board. The support unit includes a first support bar and a second support bar. The first support bar is mounted on a bottom of the waist board and connected with the push rod. The second support bar is mounted on the bottom of the hip board. The first support bar is provided with a mounting bracket connected with the push rod. The at least one track unit includes a slideway and a slide. The slideway is mounted on the bed frame and located at two sides of the back board and the head board. The slide is mounted on a bottom of the back board and is slidable on the slideway. The at least one hinge unit includes a first hinge and a second hinge. The first hinge has a first end connected with the first support bar and a second end connected with the second support bar. The second hinge has a first end mounted on mounted on the bottom of the back board and a second end mounted on the bottom of the waist board.

According to the primary advantage of the present invention, the waist board is pushed by the electric cylinder when the back board lies or is lifted, so that the waist board is operated independently and is lifted or lowered freely according to the user's requirement.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
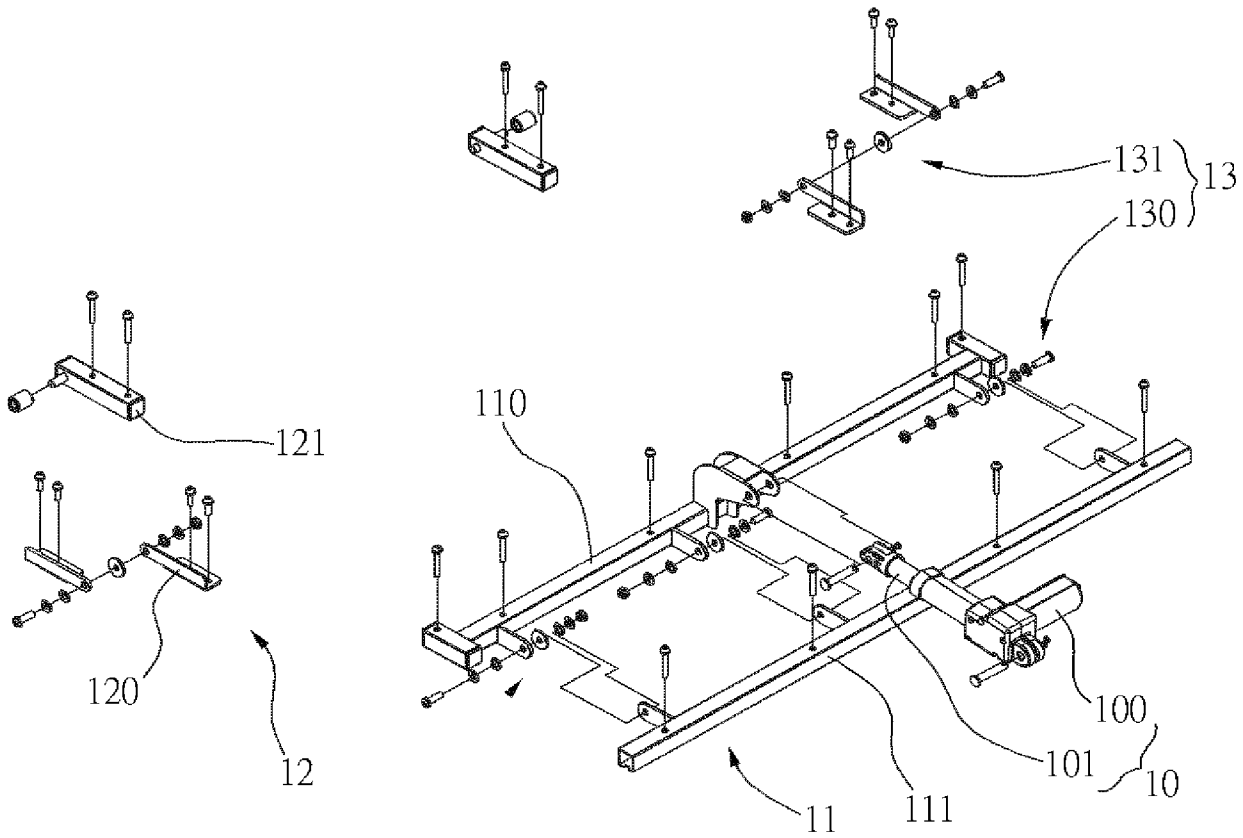
FIG. 1 is an exploded perspective view of an adjusting device in accordance with the preferred embodiment of the present invention.

Referring to the drawings and initially to FIG. 1, an electric bed in accordance with the preferred embodiment of the present invention comprises an adjusting device. The adjusting device includes a driving unit 10, a support unit 11, at least one track unit 12 and at least one hinge unit 13. The driving unit 10 includes an electric cylinder 100 and a push rod 101. The support unit 11 includes a first support bar 110 and a second support bar 111. Each of the first support bar 110 and the second support bar 111 has an elongate shape. The at least one track unit 12 includes a slideway 120 and a slide 121. The at least one hinge unit 13 includes a first hinge 130 and a second hinge 131. The first hinge 130 is secured between the first support bar 110 and the second support bar 111. The second hinge 131 is mounted on a bed board.

In the preferred embodiment of the present invention, the adjusting device includes two track units 12 and two hinge units 13.

Figure 2:
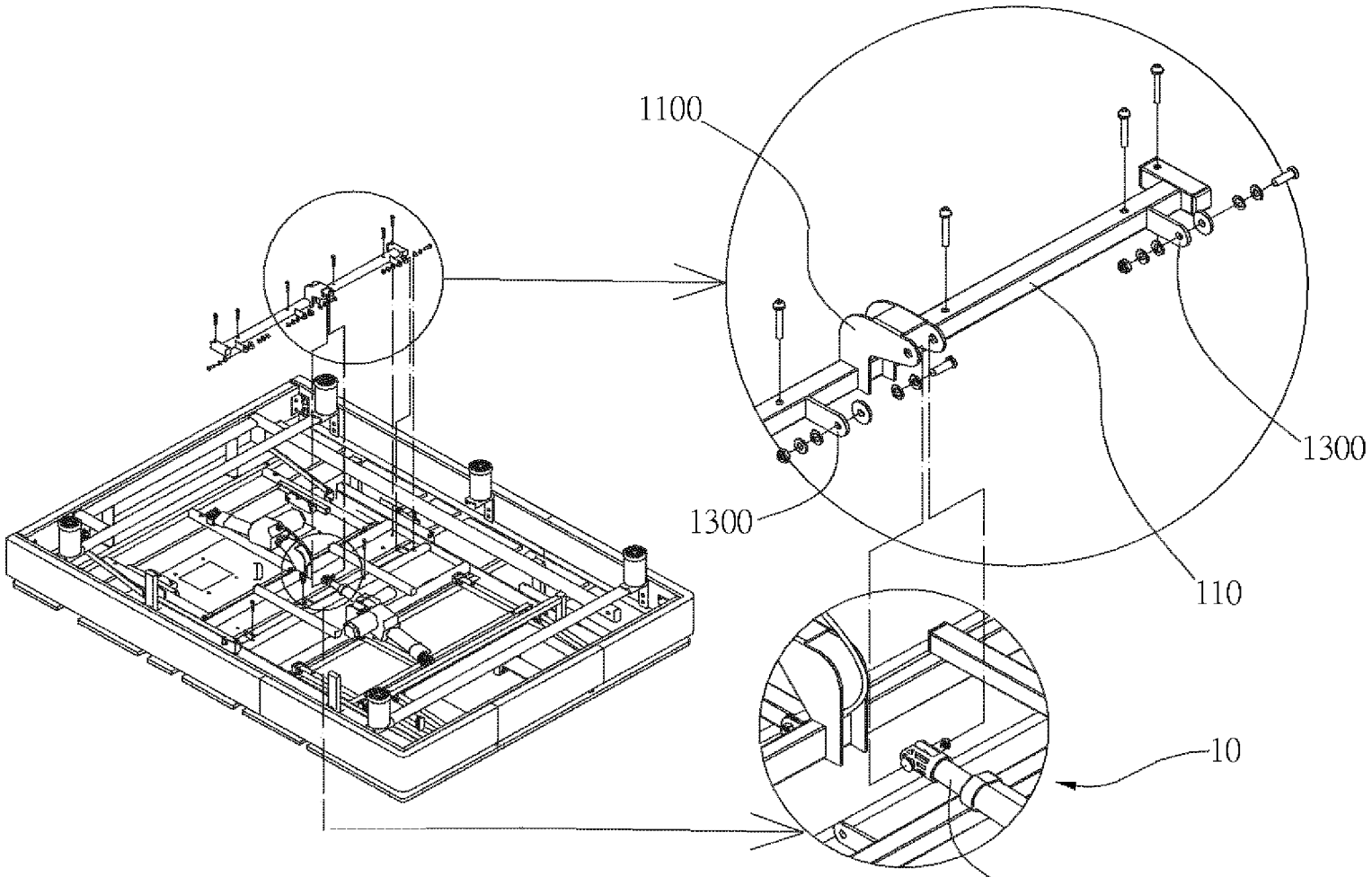
FIG. 2 is an exploded perspective view of a support unit of the adjusting device in accordance with the preferred embodiment of the present invention.
Figure 3:
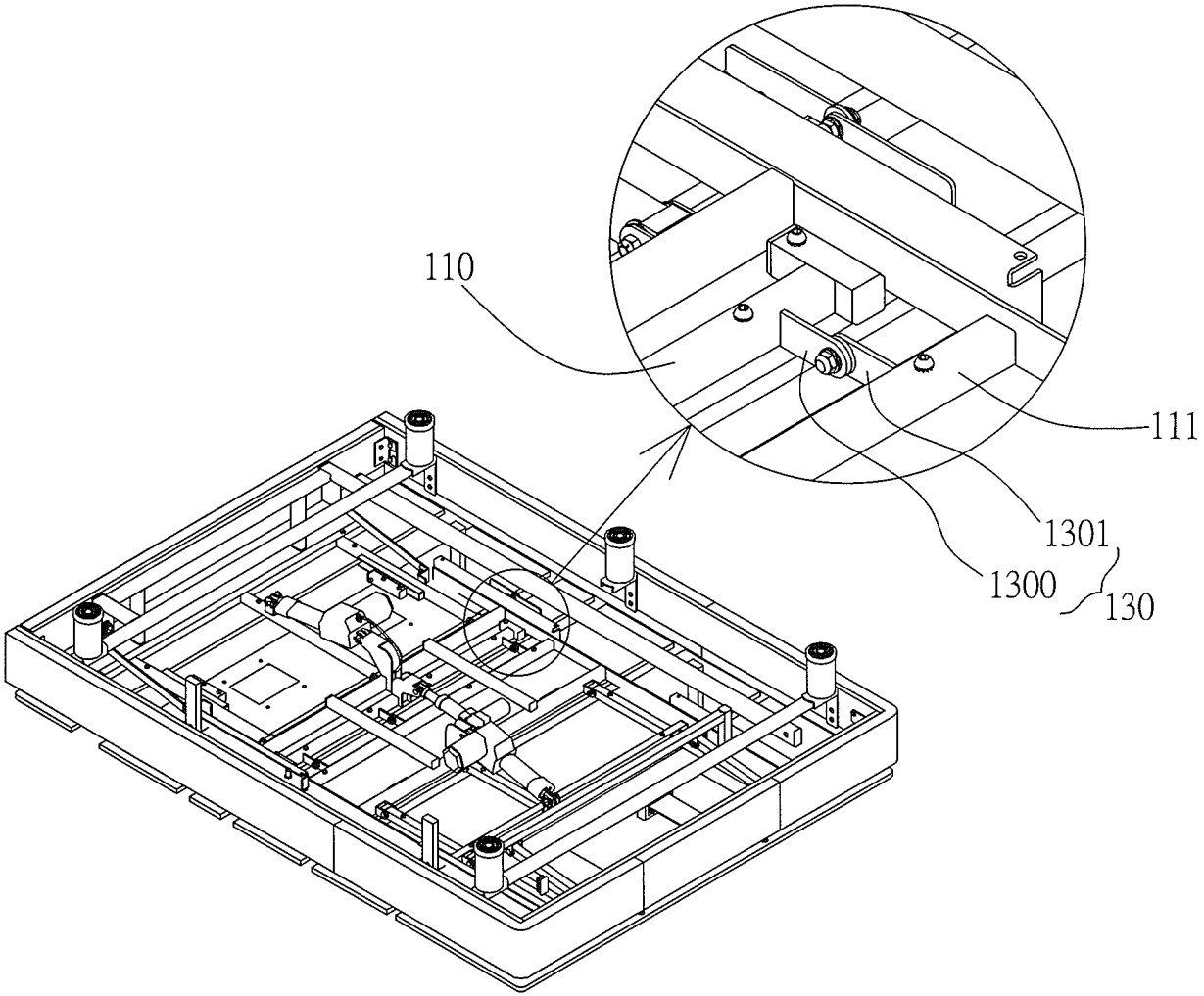
FIG. 3 is a perspective view of the support unit of the adjusting device in accordance with the preferred embodiment of the present invention.

Referring now to FIGS. 2 and 3, the first support bar 110 is provided with a mounting bracket 1100 connected with the push rod 101 by screwing. The first hinge 130 has a first end 1300 connected with the first support bar 110 and a second end 1301 connected with the second support bar 111. The first end 1300 and the second end 1301 of the first hinge 130 are connected pivotally.

Figure 4:
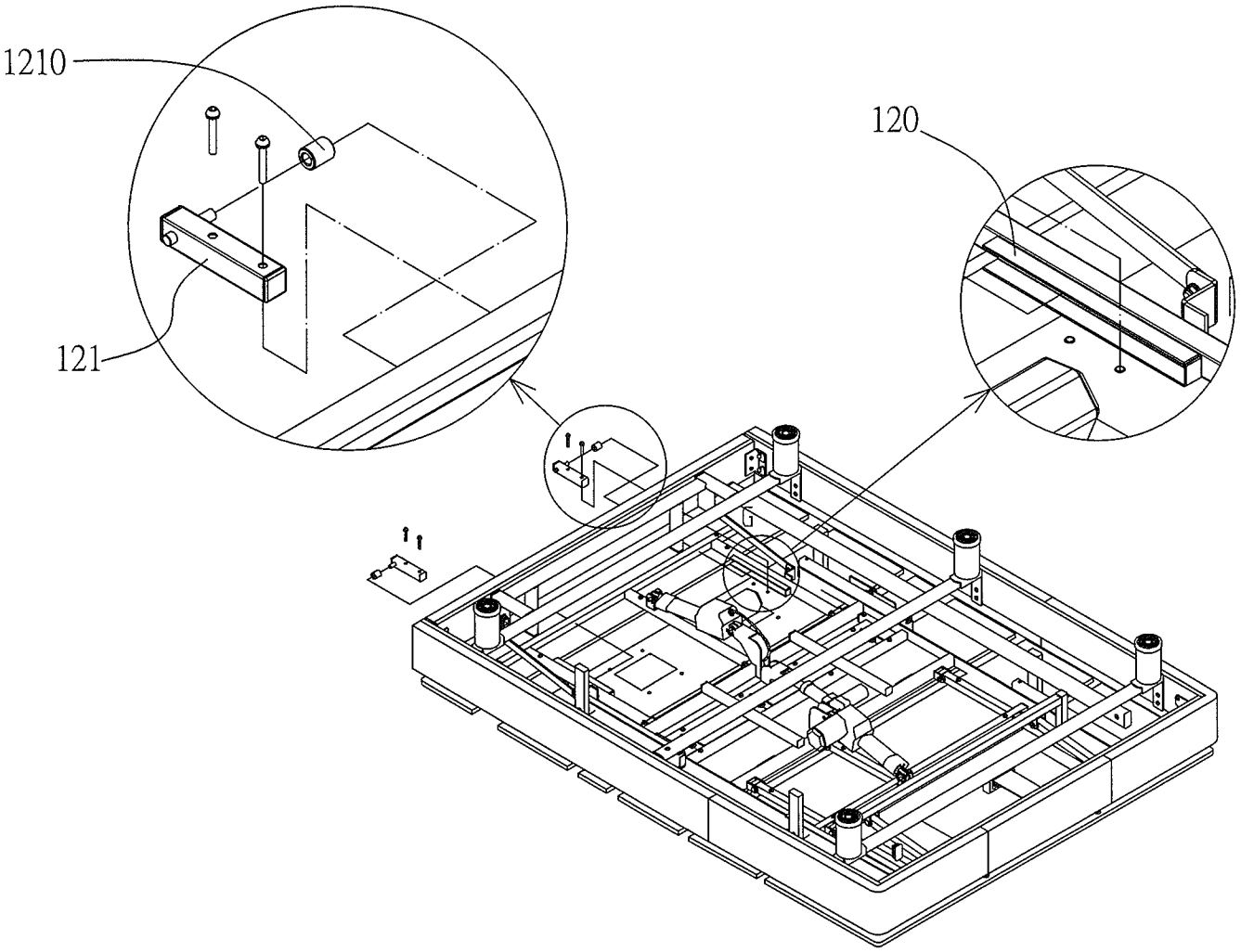
FIG. 4 is an exploded perspective view of a track unit of the adjusting device in accordance with the preferred embodiment of the present invention.
Figure 5:
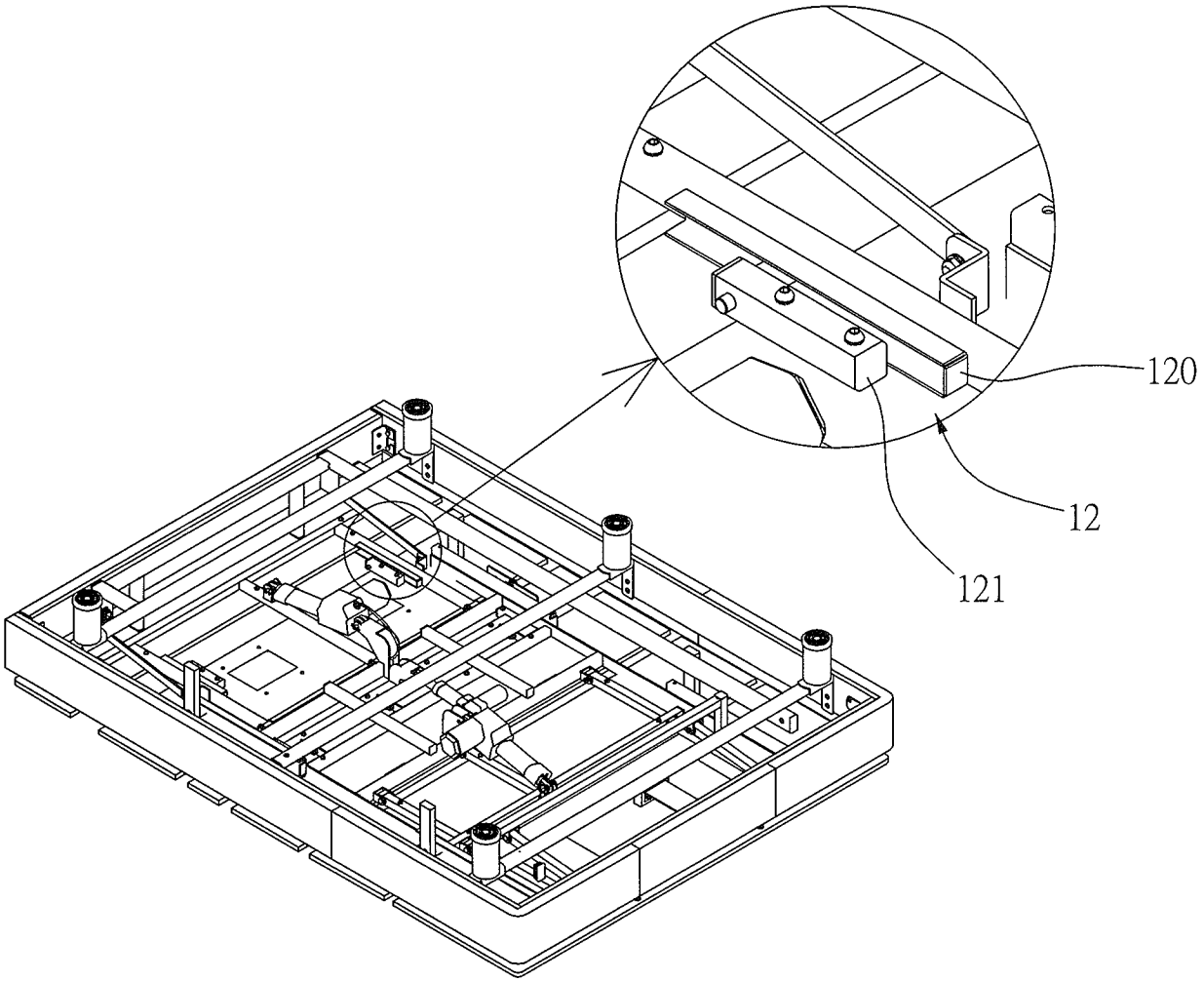
FIG. 5 is a perspective assembly view of the track unit of the adjusting device in accordance with the preferred embodiment of the present invention.

Referring now to FIGS. 4 and 5, the slideway 120 is mounted on a bed board, and the slide 121 is provided with a roller 1210 rotatably mounted in the slideway 120, so that the slide 121 is slidable on the slideway 120.

Figure 6:
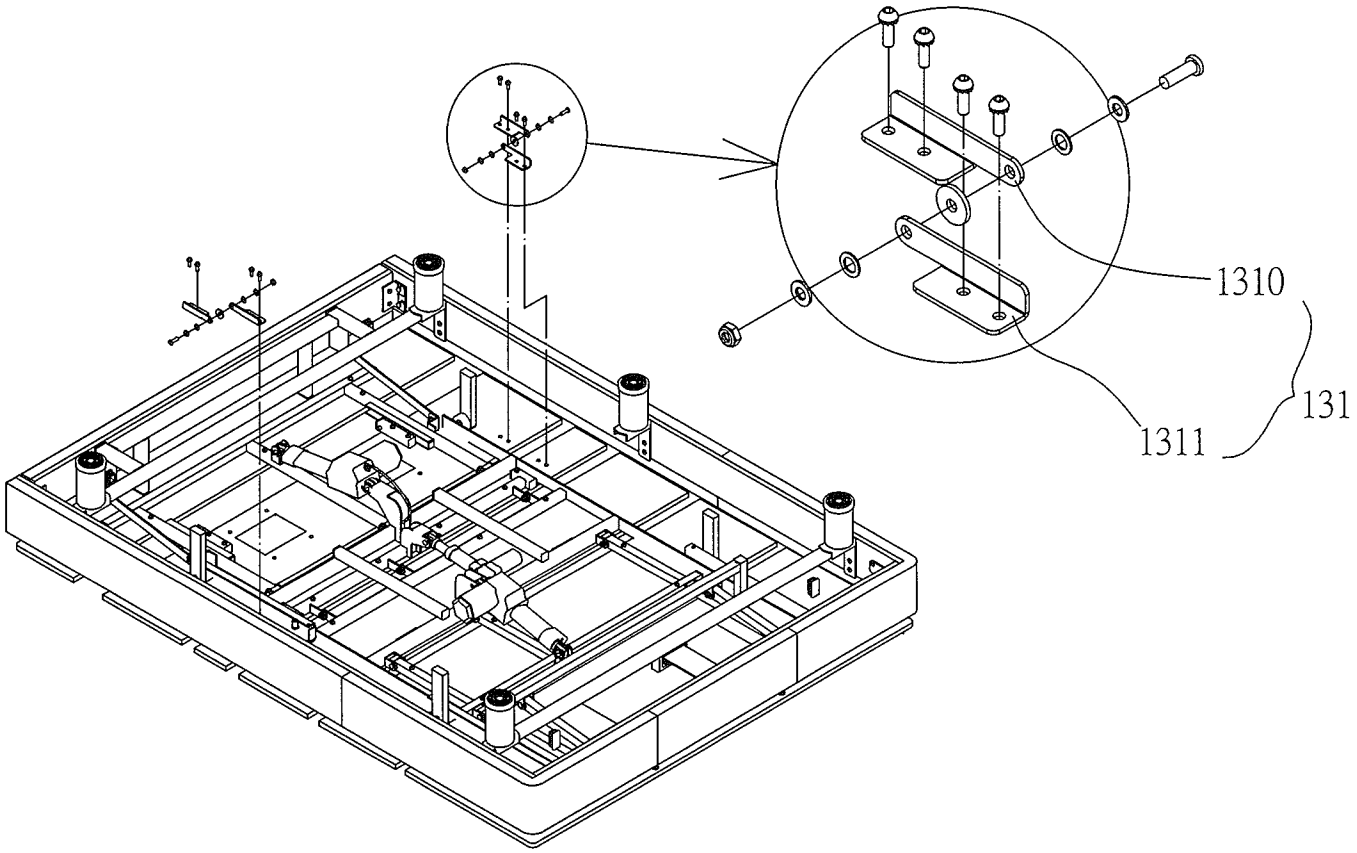
FIG. 6 is an exploded perspective view of a hinge unit of the adjusting device in accordance with the preferred embodiment of the present invention.

Referring now to FIG. 6, the second hinge 131 has a first end 1310 mounted on a bed board and a second end 1311 mounted on a bed board.

Figure 7:
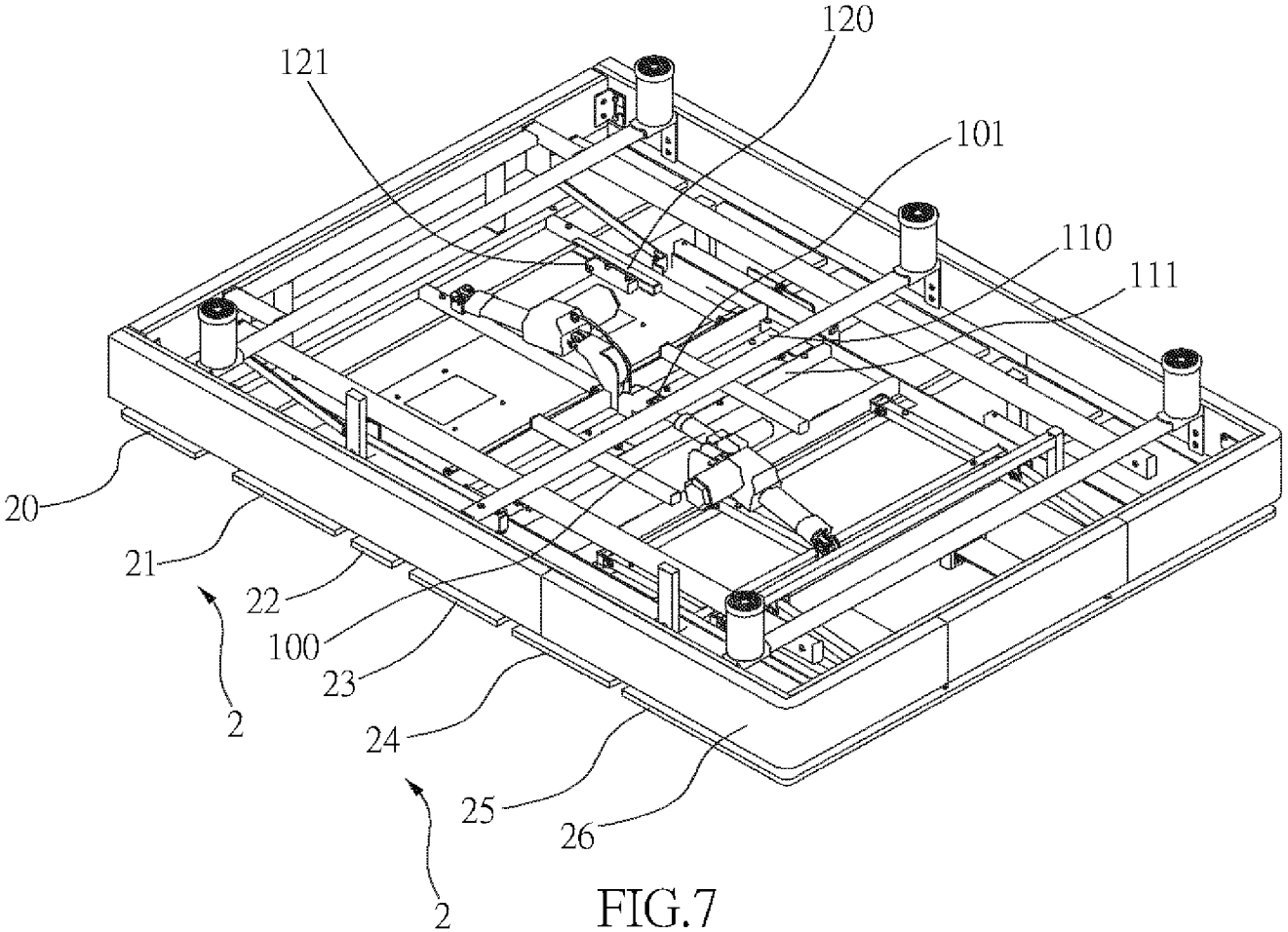
FIG. 7 is a bottom perspective view of an electric bed in accordance with the preferred embodiment of the present invention.
Figure 8:
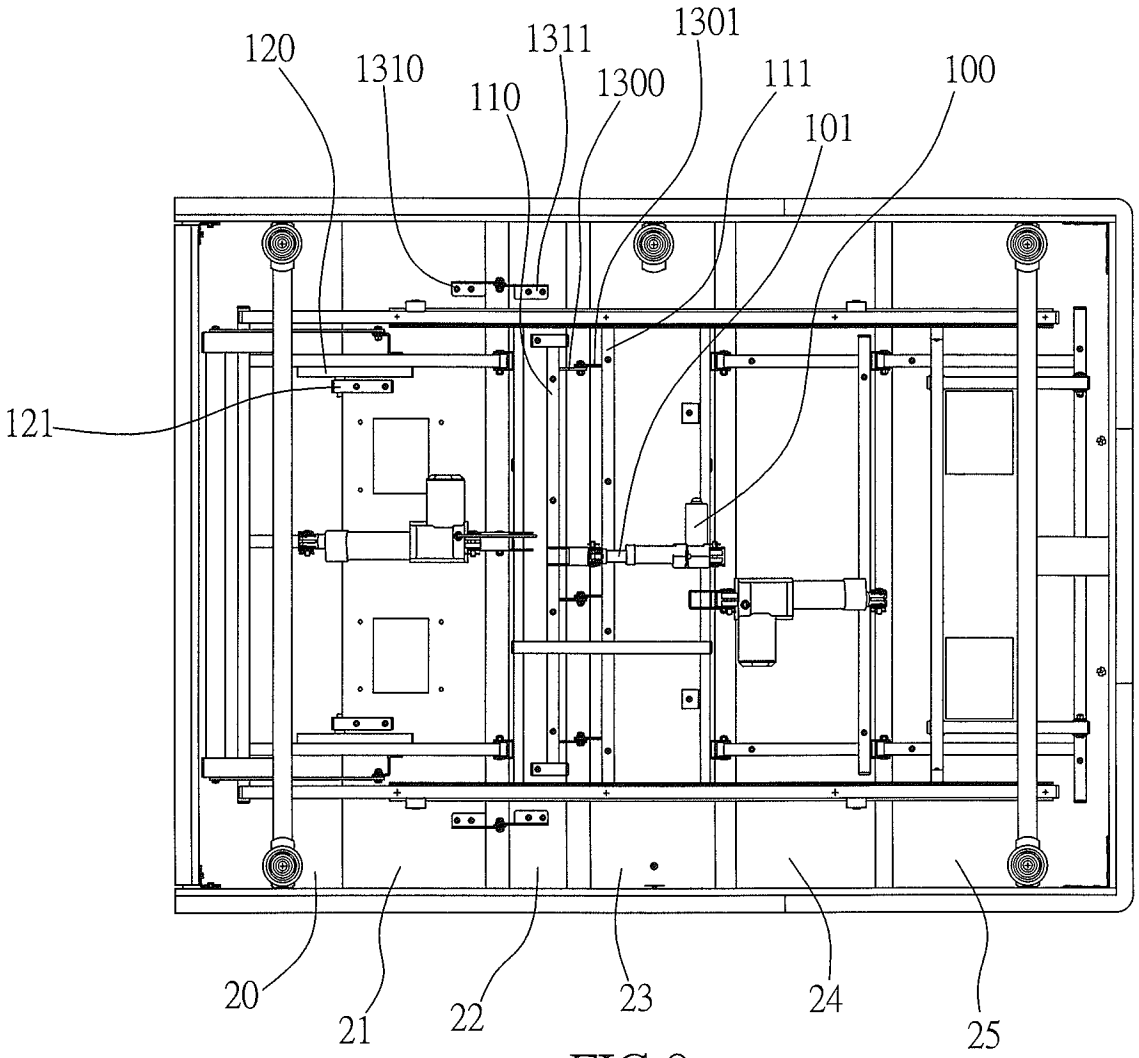
FIG. 8 is a bottom view of the electric bed in accordance with the preferred embodiment of the present invention.

Referring now to FIGS. 7 and 8, the electric bed further comprises a bed board unit 2, and the adjusting device is mounted on the bed board unit 2. The bed board unit 2 includes a head board 20, a back board 21, a waist board 22, a hip board 23, a leg board 24 and a foot board 25. The bed board unit 2 further includes a bed frame 26 located under the head board 20, the back board 21, the waist board 22, the hip board 23, the leg board 24 and the foot board 25 for supporting the head board 20, the back board 21, the waist board 22, the hip board 23, the leg board 24 and the foot board 25. The electric cylinder 100 is secured on the bottom of the hip board 23. The push rod 101 is extended and connected with the mounting bracket 1100. The first support bar 110 is mounted on the bottom of the waist board 22 and connected with the push rod 101, so that the push rod 101 is driven to push the waist board 22. The second support bar 111 is mounted on the bottom of the hip board 23. The first end 1300 of the first hinge 130 is mounted on the first support bar 110, and the second end 1301 of the first hinge 130 is mounted on the second support bar 111. Thus, the first hinge 130 is connected between the first support bar 110 and the second support bar 111, so that the first hinge 130 is connected between the waist board 22 and the hip board 23. The first end 1310 of the second hinge 131 is mounted on the bottom of the back board 21 by screwing, and the second end 1311 of the second hinge 131 is mounted on the bottom of the waist board 22 by screwing. Thus, the second hinge 131 is connected between the back board 21 and the waist board 22. The slideway 120 is mounted on the bed frame 26 and located at two sides of the back board 21 and the head board 20. The slide 121 is mounted on the bottom of the back board 21.

Figure 9:
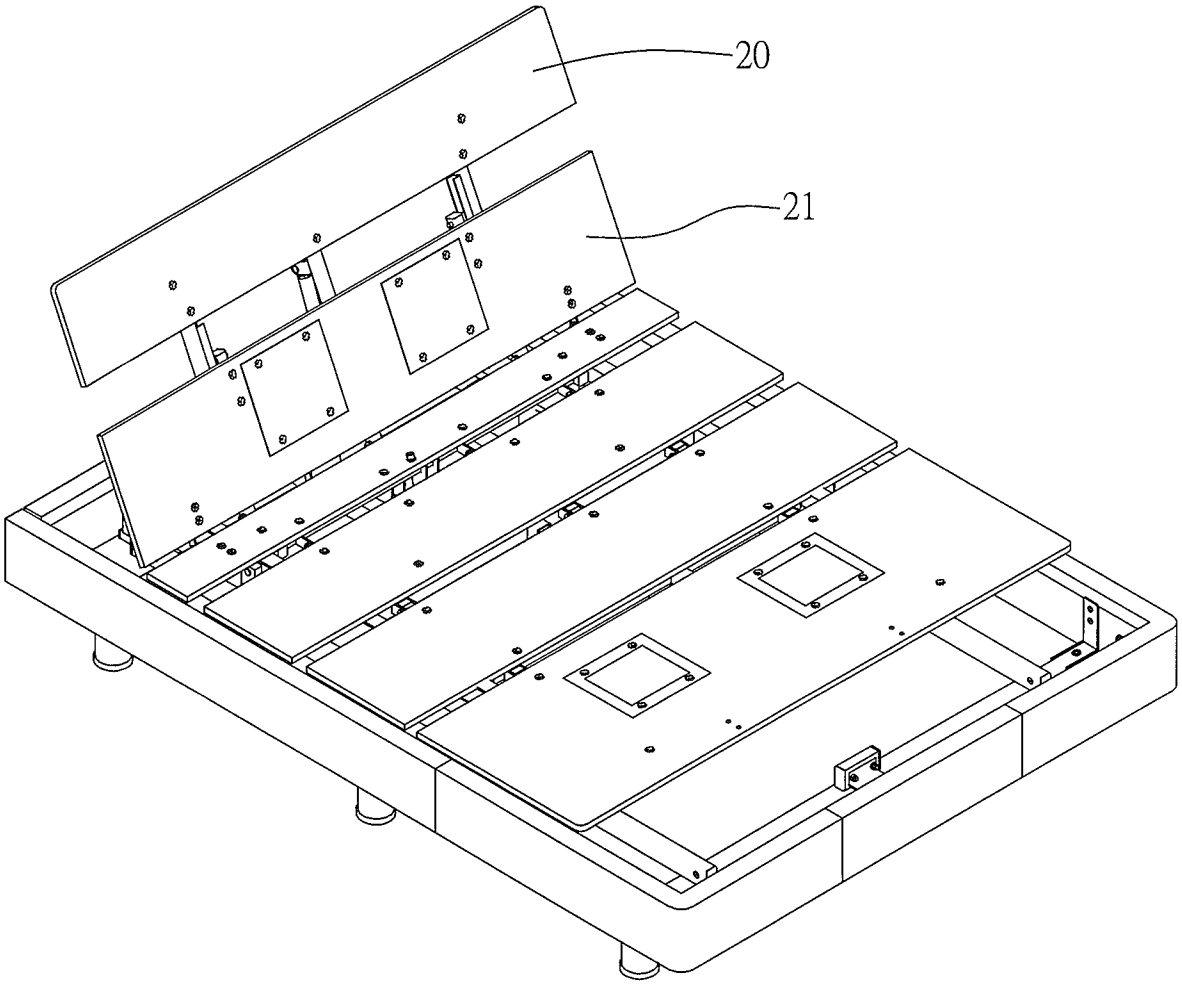
FIG. 9 is a perspective view of the electric bed before use.
Figure 10:
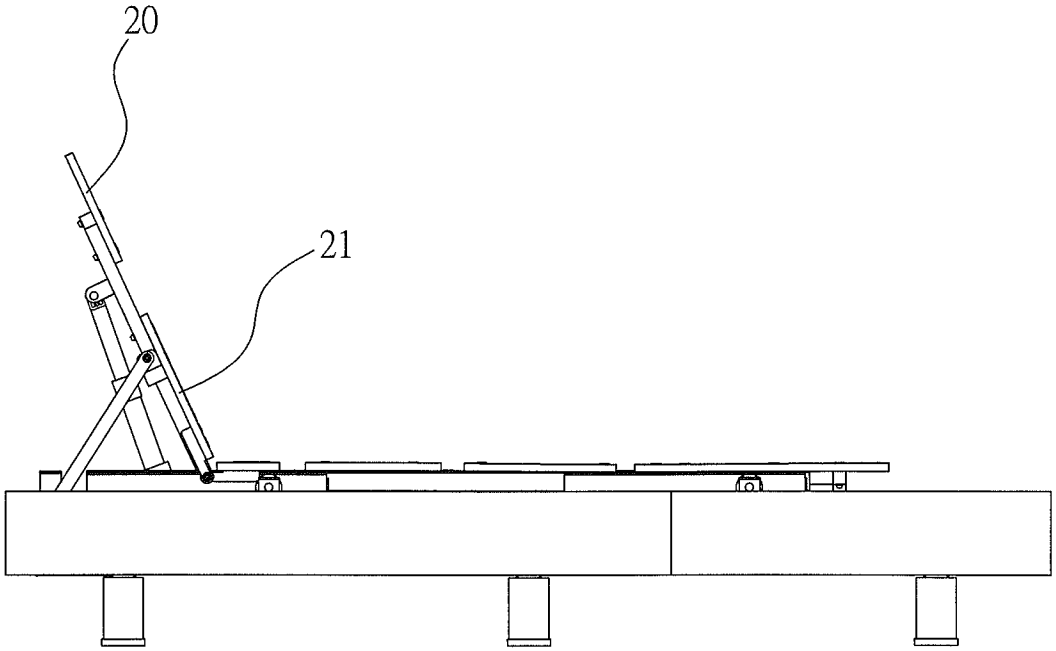
FIG. 10 is a side view of the electric bed before use.

Referring now to FIGS. 9 and 10, the head board 20 and the back board 21 are lifted before use. Preferably, the head board 20 and the back board 21 are lifted by another electric cylinder.

Figure 11:
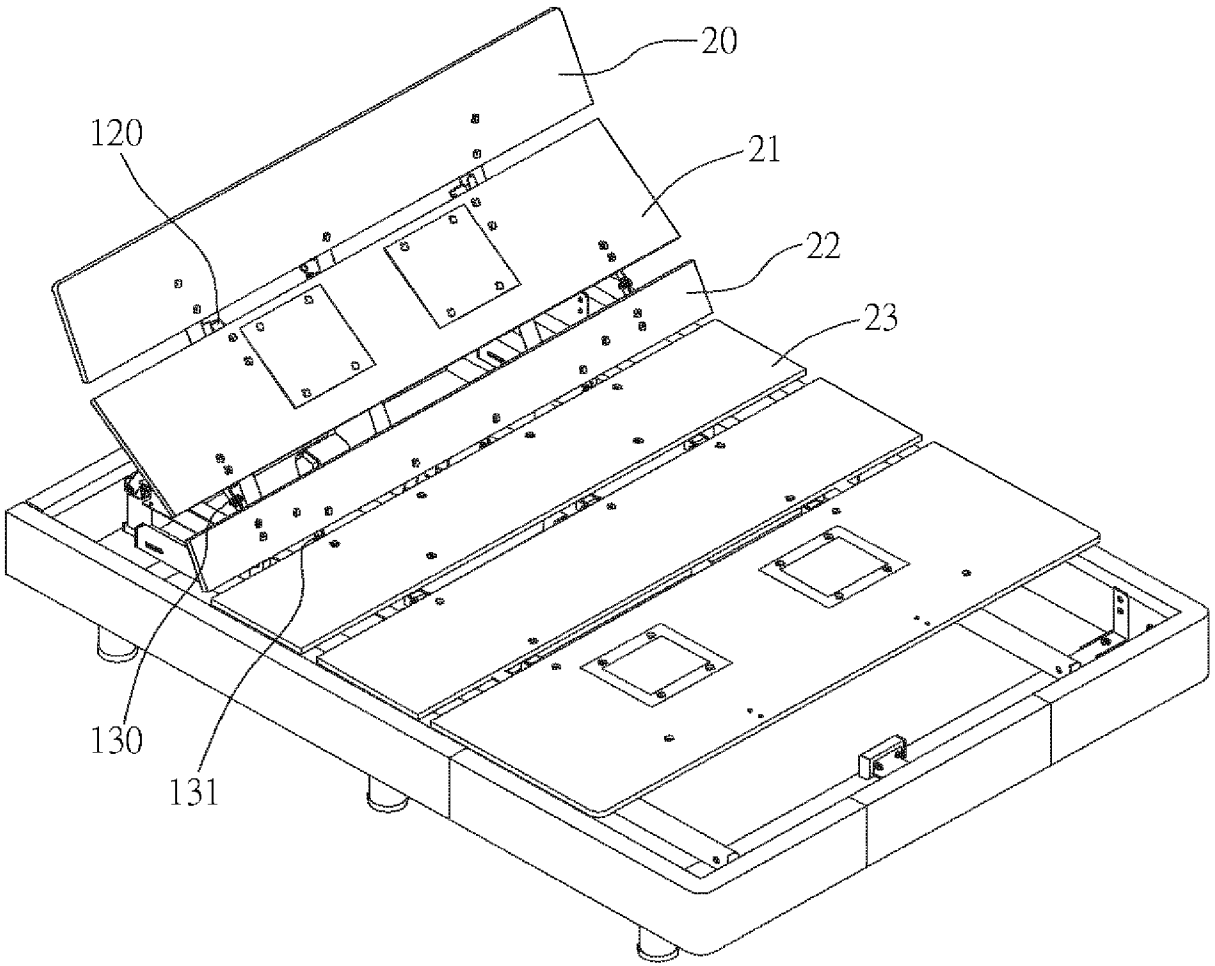
FIG. 11 is a perspective view of the electric bed in use.
Figure 12:
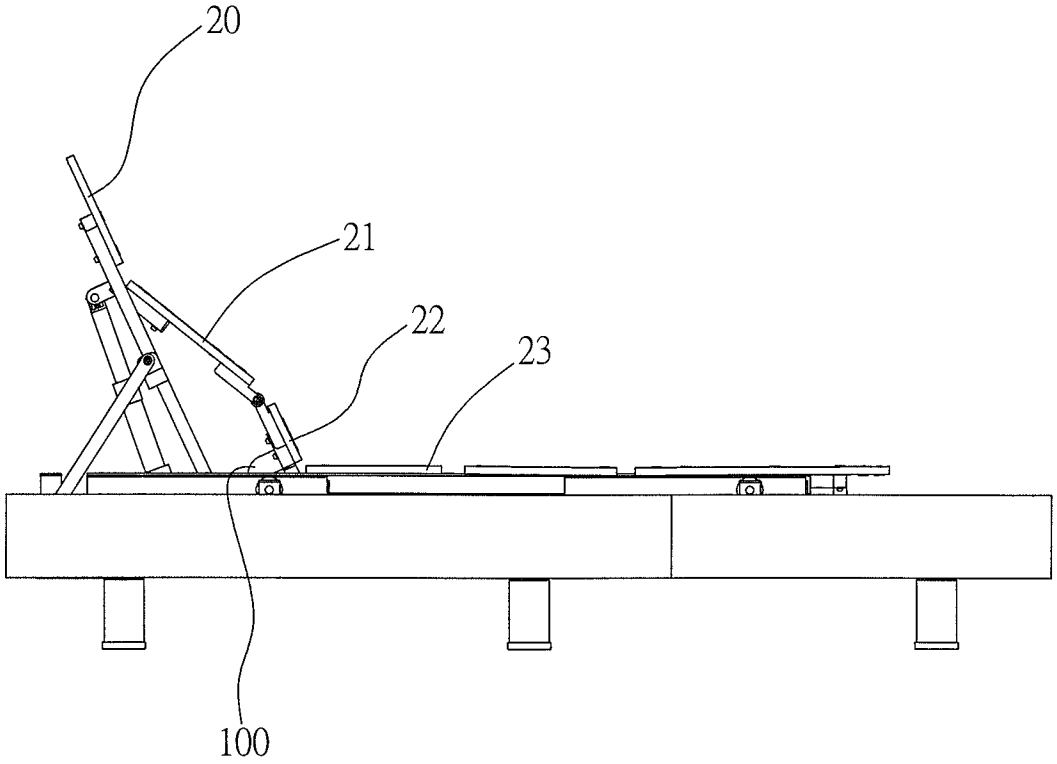
FIG. 12 is a side view of the electric bed in use.

Referring now to FIGS. 11 and 12, the first hinge 130 is connected between the waist board 22 and the hip board 23, so that when the push rod 101 pushes the waist board 22 upward, the lower end of the waist board 22 is pivoted upward by action of the first hinge 130. At this time, the second hinge 131 is connected between the back board 21 and the waist board 22, so that the upper end of the waist board 22 is moved upward by action of the second hinge 131 and forms an angle. At the same time, the waist board 22 pushes the back board 21 when the push rod 101 is pushed by the electric cylinder 100, so that the slide 121, which is mounted on the back board 21, slides upward in the slideway 120. Thus, the waist board 22 is pushed upward.

Figure 13:
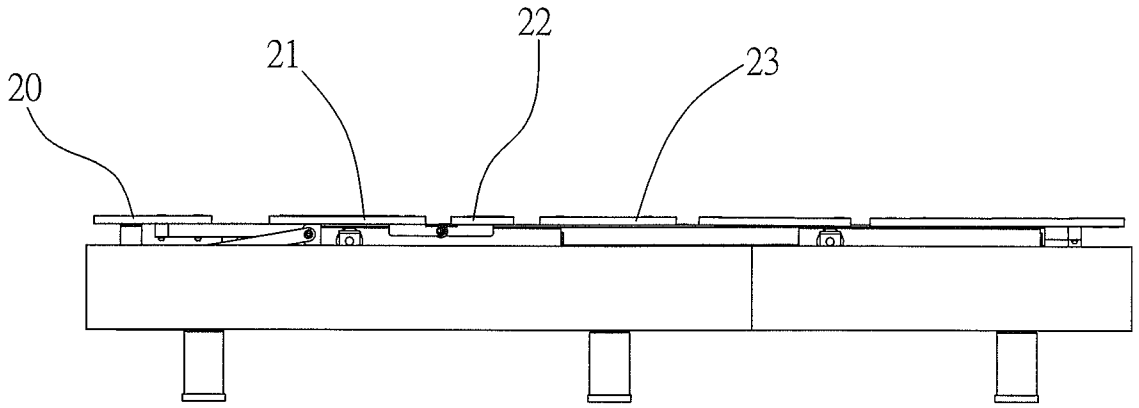
FIG. 13 is another side view of the electric bed before use.

Referring now to FIG. 13, the head board 20 and the back board 21 are disposed at a horizontal state before use.

Figure 14:
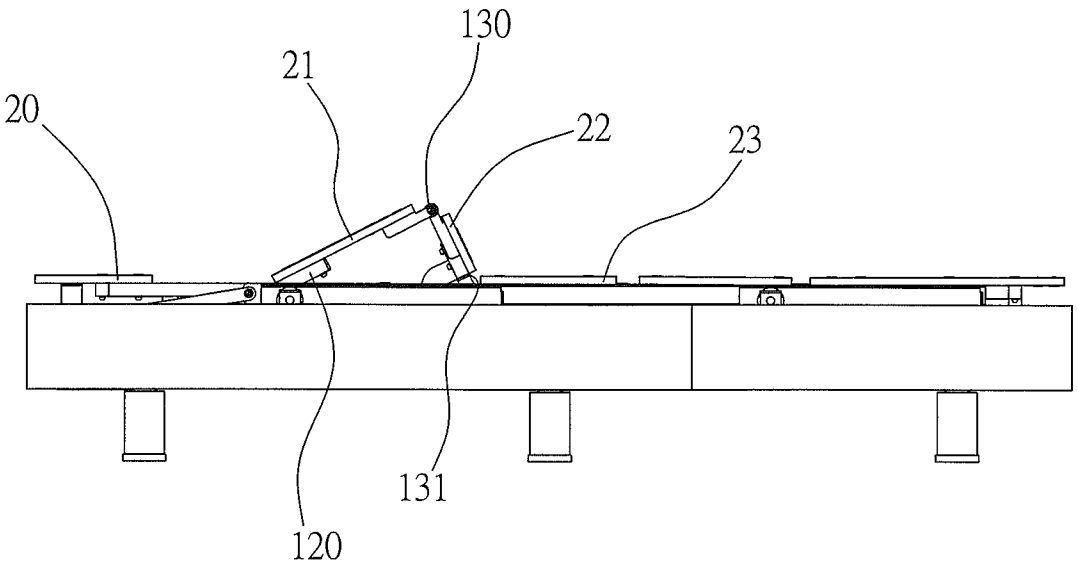
FIG. 14 is another side view of the electric bed before use.

Referring now to FIG. 14, the first hinge 130 is connected between the waist board 22 and the hip board 23, so that when the push rod 101 pushes the waist board 22 upward, the lower end of the waist board 22 is pivoted upward by action of the first hinge 130. At this time, the second hinge 131 is connected between the back board 21 and the waist board 22, so that the upper end of the waist board 22 is moved upward by action of the second hinge 131 and forms an angle. At the same time, the waist board 22 pulls the back board 21 when the push rod 101 is pulled by the electric cylinder 100, so that the slide 121, which is mounted on the back board 21, slides downward in the slideway 120. Thus, the waist board 22 is pushed upward.

In conclusion, the driving unit 10 is used to push the waist board 22 so as to lift or lower the waist board 22, the support unit 11 is used to support the waist board 22 and is pushed by the driving unit 10, the at least one track unit 12 is used to drive movement of the back board 21, and the at least one hinge unit 13 is used to connect the back board 21 and the waist board 22 when the waist board 22 is lifted or lowered.

Accordingly, the waist board 22 is pushed by the electric cylinder 100 when the back board 21 lies or is lifted, so that the waist board 22 is operated independently and is lifted or lowered freely according to the user's requirement, to facilitate the user operating the waist board 22, and to provide a comfortable sensation to the user when lying on the electric bed.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An electric bed comprising:

a bed board unit; and an adjusting device mounted on a bottom of the bed board unit;

wherein:

the bed board unit includes a head board, a back board, a waist board, a hip board, a leg board and a foot board;

the bed board unit further includes a bed frame located under the head board, the back board, the waist board, the hip board, the leg board and the foot board;

the adjusting device includes a driving unit, a support unit, at least one track unit and at least one hinge unit;

the driving unit includes an electric cylinder and a push rod;

the electric cylinder is secured on and directly connected with a bottom of the hip board;

the support unit includes a first support bar and a second support bar;

the first support bar is mounted on a bottom of the waist board and connected with the push rod;

the second support bar is mounted on and directly connected with the bottom of the hip board;

the first support bar is provided with a mounting bracket connected with the push rod;

the at least one track unit includes a slideway and a slide;

the slideway is mounted on the bed frame and located at two sides of the back board and the head board;

the slide is mounted on a bottom of the back board and is slidable on the slideway;

the at least one hinge unit includes a first hinge and a second hinge;

the first hinge has a first end connected with the first support bar and a second end connected with the second support bar;

the second hinge has a first end mounted on the bottom of the back board and a second end mounted on the bottom of the waist board;

the waist board is pushed by the electric cylinder and the push rod, and is lifted or lowered independently; and the waist board is lifted or lowered independently when the head board is disposed at a horizontal state.

2. The electric bed of claim 1, wherein the back board is moved upward or downward relative to the waist board.

3. The electric bed of claim 1, wherein the back board is arranged between the head board and the waist board.

4. The electric bed of claim 1, wherein the waist board has a first end juxtaposed to the back board and a second end juxtaposed to the hip board.

5. The electric bed of claim 1, wherein the first end and the second end of the first hinge are connected pivotally.

6. The electric bed of claim 1, wherein the first support bar is secured to the bottom of the waist board.

7. The electric bed of claim 1, wherein the mounting bracket of the first support bar is pivotally connected with the push rod.

8. The electric bed of claim 1, wherein the mounting bracket has a first end secured to the first support bar and a second end pivotally connected with the push rod.

9. The electric bed of claim 1, wherein the second support bar is secured to the bottom of the hip board.

10. The electric bed of claim 1, wherein the first hinge pivotally connects the waist board and the hip board.

11. The electric bed of claim 1, wherein the slide is provided with a roller rotatably mounted in the slideway.

* * * * *